US009475181B2

(12) United States Patent
Kim

(10) Patent No.: US 9,475,181 B2
(45) Date of Patent: Oct. 25, 2016

(54) DISTORTION-TOLERANT SPLIT RING PLIERS FOR A WIDE RANGE OF APPLICATIONS

(71) Applicant: Il Han Kim, Daegu (KR)

(72) Inventor: Il Han Kim, Daegu (KR)

( * ) Notice: Subject to any disclaimer, the term of this patent is extended or adjusted under 35 U.S.C. 154(b) by 0 days.

(21) Appl. No.: 14/989,267

(22) Filed: Jan. 6, 2016

(65) Prior Publication Data

US 2016/0214245 A1 Jul. 28, 2016

(30) Foreign Application Priority Data

Jan. 28, 2015 (KR) ..... 10-2015-0013555

(51) Int. Cl.

| | |
|---|---|
| ***B25B 11/00*** | (2006.01) |
| ***B25B 27/14*** | (2006.01) |
| ***B25B 7/02*** | (2006.01) |
| *B25B 27/00* | (2006.01) |
| *B25B 7/00* | (2006.01) |

(52) U.S. Cl.

CPC ..... *B25B 27/14* (2013.01); *B25B 7/02* (2013.01); *B25B 27/143* (2013.01); *B25B 7/00* (2013.01); *B25B 27/00* (2013.01)

(58) Field of Classification Search

CPC ..... B25B 27/14; B25B 7/02; B25B 27/00; B25B 9/02; B25B 27/143; B25B 27/146; B25B 7/00

See application file for complete search history.

(56) References Cited

U.S. PATENT DOCUMENTS 3,564,694 A * 2/1971 Millheiser ..... B25B 27/205 29/229
4,280,265 A * 7/1981 Murphy ..... B25B 27/205 29/229
4,316,315 A * 2/1982 Vogelnik ..... B25B 27/205 29/229
5,084,935 A * 2/1992 Kalthoff ..... A61C 7/04 140/106
5,395,236 A * 3/1995 Khouri ..... A61C 7/04 140/106
6,050,123 A * 4/2000 Fies ..... B25B 7/02 413/22
7,670,357 B2 * 3/2010 Rettich ..... A61B 17/8861 606/205
8,347,471 B2 * 1/2013 Wang ..... B25B 7/14 29/229

(Continued)

*Primary Examiner* — Hadi Shakeri
*Assistant Examiner* — Danny Hong
(74) *Attorney, Agent, or Firm* — Cowan Liebowitz & Latman, P.C.

(57) ABSTRACT

The present disclosure relates to multipurpose pliers including a pivot section (20), a handle section (30) connected to the pivot section (20) on one direction, and a pair of lever sections (10A, 10B) connected to the pivot section (20) on an opposite direction to the one direction, wherein the lever sections (10A, 10B) include a split ring insertion part (11), the split ring insertion part (11) includes a bottom support portion (11B) protruding in a direction perpendicular to a longitudinal axis (L-axis) of the multipurpose pliers at an end of a direction facing away from the pivot section on one (10A) of the pair of lever sections, a tapered portion (11A) extending in the perpendicular direction from top of the bottom support portion (11B) and gradually narrowing to a tip, a convex forming portion (11C) formed on a side surface toward the pivot section of the tapered portion (11A) and the bottom support portion (11B), a concave forming portion (11 D) formed at an end of the other (10B) of the pair of lever sections to guide the convex forming portion (11C) on the side surface of the bottom support portion (11B) and the tapered portion (11A), and a split ring retaining portion (11E) formed in a concave shape on both side directions from the concave forming portion (11D), a size of an upper surface of the bottom support portion (11B) is larger than or equal to a size of a bottom surface of the tapered portion (11A), and a gap (210) between rings of a split ring (200) are opened using the tapered portion (11A).

2 Claims, 8 Drawing Sheets

(56) References Cited

U.S. PATENT DOCUMENTS 8,656,570 B2 * 2/2014 Foley ..... B25C 11/02
254/28

2012/0151770 A1 * 6/2012 Davies ..... B25B 7/02
29/897.3

* cited by examiner

DISTORTION-TOLERANT SPLIT RING PLIERS FOR A WIDE RANGE OF APPLICATIONS

TECHNICAL FIELD

The present disclosure relates to multipurpose pliers, and more particularly, to distortion-tolerant split ring pliers for a wide range of applications.

BACKGROUND ART

Pliers are a hand tool used to hold objects firmly, possibly developed from tongs used to handle hot metal in Bronze Age Europe.

The pliers are used for bending, compressing or cutting objects made from a wide range of materials, and they consist of a pair of lever sections on one side with respect to a pivot and a pair of handle sections on the other side, allowing a force applied to the handle to move the lever sections around the pivot.

The force acts on the lever sections and the handle across the pivot which serves as a fulcrum.

The present disclosure relates to pliers into which many functions required in preparation for fishing with traditional pliers are integrated, but the present disclosure is not limited to fishing and may be used in a wide range of fields.

In preparation for fishing, various functions are needed, for example, a function of cutting a fishing line such as, for example, a polyethylene line (fishing line), a carbon line and a nylon line, or cutting a wire and a line including a wire, and a function of attaching a fishing bait and a fishing hook to a split ring, and the present disclosure relates to pliers having these various functions.

Fishing pliers such as the present disclosure are disclosed in Utility Model Registration Nos. 20-0202732 and 20-0296965, but the related arts do not describe a function for split rings and a function for preventing distortion caused thereby.

DISCLOSURE

Technical Problem

The present disclosure is directed to providing pliers into which many functions required in preparation for fishing with traditional pliers are integrated, in particular, pliers intended for use in attaching a fishing artificial bait or a fishing hook to a split ring.

Also, the pliers of the present disclosure are designed to resist a twisting force occurring while opening up rings of a split ring or a twisting force occurring while cutting a fishing line.

Also, the pliers of the present disclosure are designed to easily replace a worn part.

Also, the pliers of the present disclosure are designed to operate in a lightweight and easy manner.

Technical Solution

The present disclosure provides multipurpose pliers 100 including a pivot section 20, a handle section 30 connected to the pivot section 20 on one direction, and a pair of lever sections 10A and 10B connected to the pivot section 20 on an opposite direction to the one direction, wherein the lever sections 10A and 10B include a split ring insertion part 11, the split ring insertion part 11 includes a bottom support portion 11B protruding in a direction perpendicular to a longitudinal axis (L-axis) of the multipurpose pliers at an end of a direction facing away from the pivot section on one 10A of the pair of lever sections, a tapered portion 11A extending in the perpendicular direction from top of the bottom support portion 11B and gradually narrowing to a tip, a convex forming portion 11C formed on a surface facing the pivot direction of the tapered portion 11A and the bottom support portion 11B, a concave forming portion 11D formed at an end of the other 10B of the pair of lever sections to guide the convex forming portion 11C on the side surface of the bottom support portion 11B and the tapered portion 11A, and a split ring retaining portion 11E formed in a concave shape on both side directions from the concave forming portion 11D, a size of an upper surface of the bottom support portion 11B is larger than or equal to a size of a bottom surface of the tapered portion 11A, and a gap 210 between rings of a split ring 200 are opened using the tapered portion 11A.

In the present disclosure, the split ring insertion part 11 is integrally formed with a concave-convex part 12 and they are inserted and assembled into bottom surfaces of each of the pair of lever sections 10A and 10B, and the integrally formed split ring insertion part 11 and the concave-convex part 12 have guide grooves 12F and the bottom surfaces of each of the pair of lever sections 10A and 10B have guide protrusions 12E, so after assembly, sway is prevented by insertion of the guide protrusions 12E into the guide grooves 12F.

Advantageous Effects

The multipurpose pliers of the present disclosure have the split ring insertion part in the lever section to open up rings of a split ring, thereby easily attaching a fishing hook or an artificial bait to the split ring.

Also, the multipurpose pliers of the present disclosure are not limited to fishing products and can be used for other products using split rings.

Also, the multipurpose pliers of the present disclosure have the distortion prevention part in at least one of the lever section and the handle section, thereby resisting a twisting force that occurs during opening up rings of a split ring or cutting a fishing line.

Also, parts more likely to wear out in the pliers of the present disclosure are connected via screw coupling, allowing for easy replacement.

Also, the pliers of the present disclosure have the plurality of through-holes and the concave and convex curves in the handle, thereby reducing the weight and facilitating work.

| [Detailed Description of Main Elements] | |
|---|---|
| 100: Multipurpose pliers | 10: Lever section |
| 20: Pivot section | 30: Handle section |
| 11: Split ring insertion part | 12: Concave-convex part |
| 13: Distortion prevention part | 14: Line cutter part |
| 15: Wire cutter part | 21: Grease insertion part |
| 31: Distortion prevention part | 32: Through-hole |

BEST MODE

Figure 1:
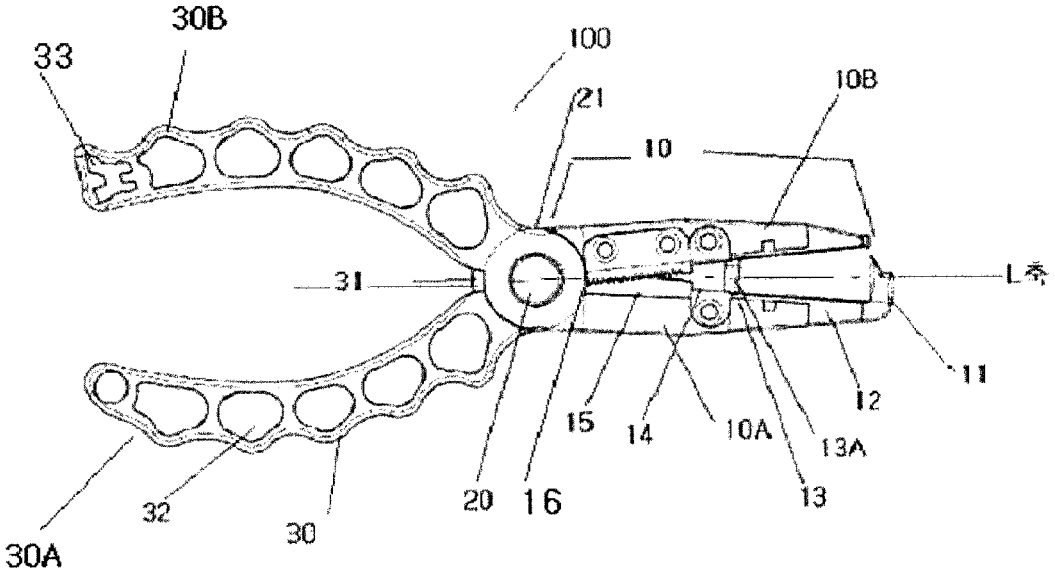
FIG. 1 is a top view of multipurpose pliers of the present disclosure.

FIG. 1 is a top view of multipurpose pliers of the present disclosure.

The multipurpose pliers of the present disclosure include a lever section 10 on one side of a pivot section 20 and a handle 30 on the other side.

As a pair of handle sections 30A and 30B are opened or closed by an applied force, the lever section 10 is opened or closed with respect to the pivot section 20, and various functions of the lever section are performed.

The lever section 10 includes a split ring insertion part 11, a concave-convex part 12, a distortion prevention part 13, a line cutter part 14, a wire cutter part 15, and a distortion prevention part 16 to provide various functions, and a grease insertion part 21 is provided on the side surface of the pivot section 20, and the handle section 30 is provided with an additional distortion prevention part 31, and each function is described as follows.

The split ring insertion part 11 is formed at the end of the lever section 10 in a direction facing away from the pivot section 20, and has a protruding shape on one 10A of the pair of lever sections 10, protruding in a direction perpendicular to the longitudinal axis direction (L) of the multipurpose pliers, and a portion accommodating the protruding shape on the other 10B of the lever sections 10.

Figure 3A:
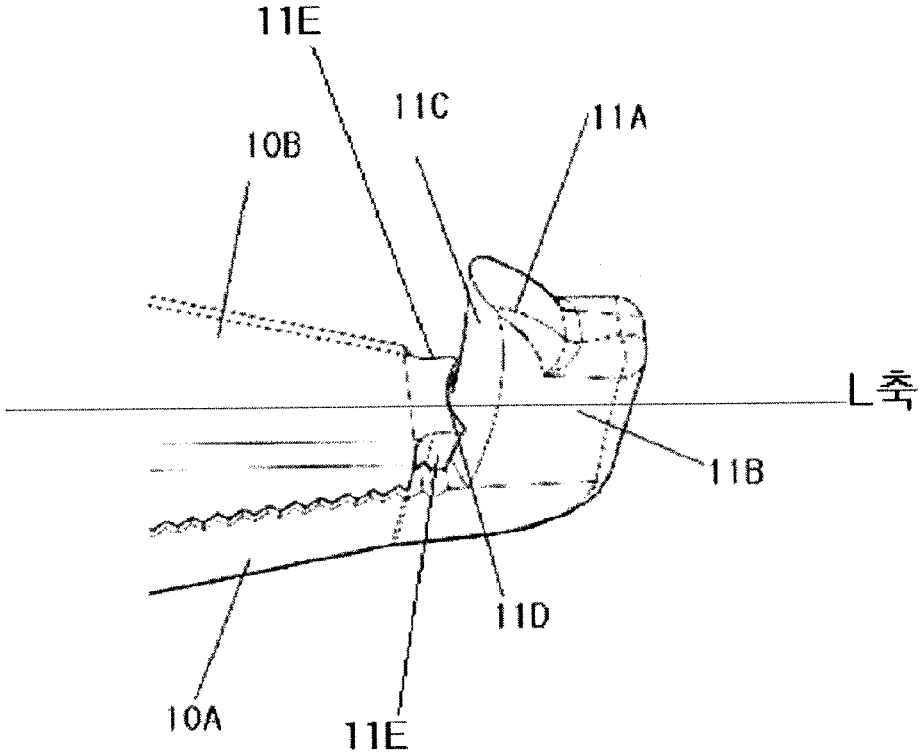
FIG. 3*a* is an enlarged view of a split ring insertion part of multipurpose pliers of the present disclosure.

Describing the split ring insertion part 11 in more detail through FIG. 3*a,* the split ring insertion part 11 includes a tapered portion 11A gradually narrowing to a tip at the end of one 10A of the lever sections 10, a bottom support portion 11B having a cross section larger than or equal to a cross section of a bottom surface of the tapered portion 11A, a convex forming portion 11C on side surfaces of the tapered portion 11A and the bottom support portion 11B, a concave forming portion 11D accommodating the convex forming portion 11C at the end of the other 10B of the lever sections 10, and a split ring retaining portion 11E to retain the location of a split ring 200 on the side direction of the concave forming portion 11D.

The length of the other 10B of the pair of lever sections 10 is shorter than the length of one 10A of the lever sections having the bottom support portion 11B by the width of the bottom support portion 11B.

Figure 3B:
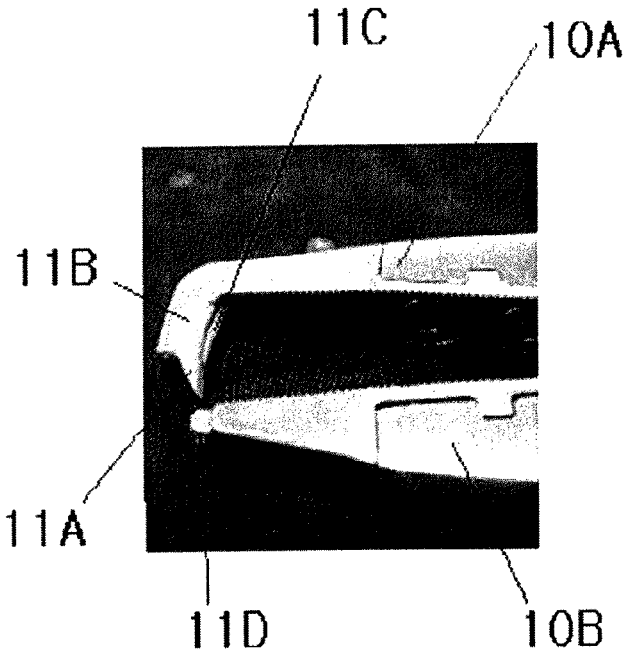
FIGS. 3*b* through 3*d* are diagrams showing an operation process of a split ring insertion part of the present disclosure.
Figure 3C:
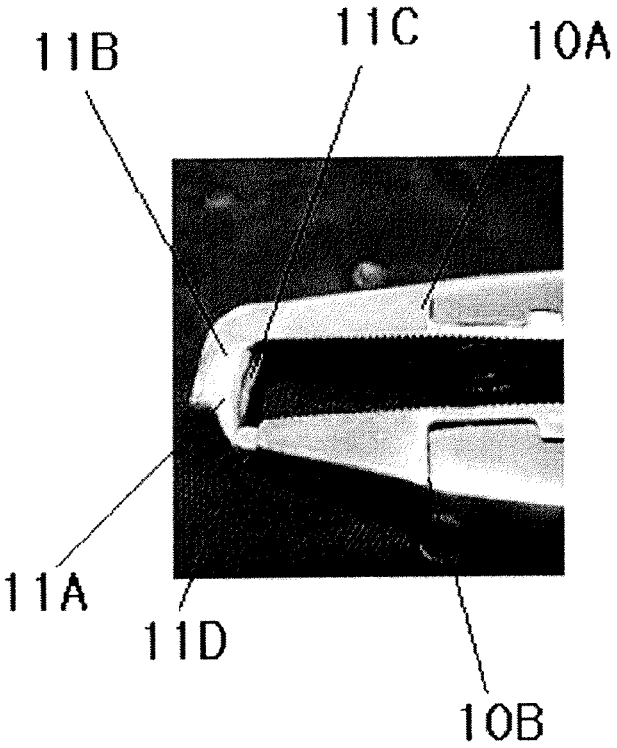
Figure 3D:
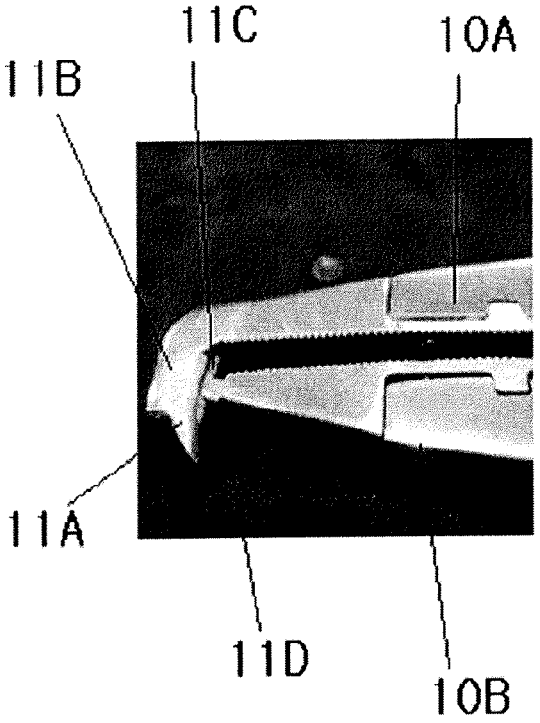

It can be seen from FIGS. 3*b* through 3*d* that when the lever sections are closed, the convex forming portion 11C of one 10A of the lever sections 10 is closed along the concave forming portion 11D of the other 10B of the lever sections 10.

Accordingly, the convex forming portion 11C of one 10A of the lever sections 10 and the concave forming portion 11D of the other 10B of the lever sections 10 act as guide rails.

Preferably, the cross section of the tapered portion 11A and the cross section of the bottom support portion 11B are discontinuous.

Figure 4A:
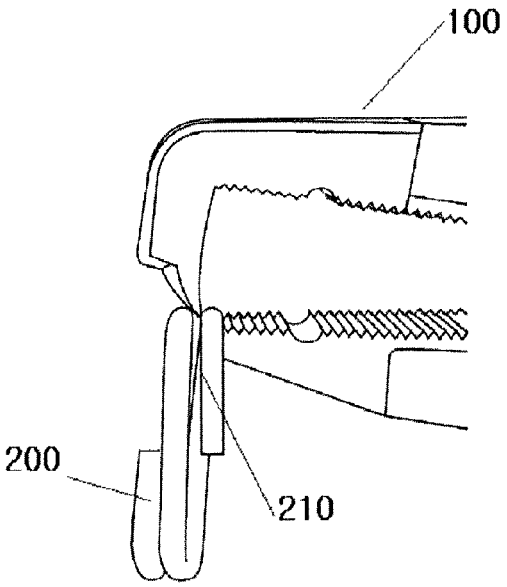
FIGS. 4*a* through 4*c* are diagrams showing a method of attaching an artificial bait to a split ring using multipurpose pliers of the present disclosure.

The tapered portion 11A has a pointed shape to allow for easy insertion into a gap 210 between rings of the split ring 200 wound in circular shape as shown in FIG. 4*a.*

Figure 4B:
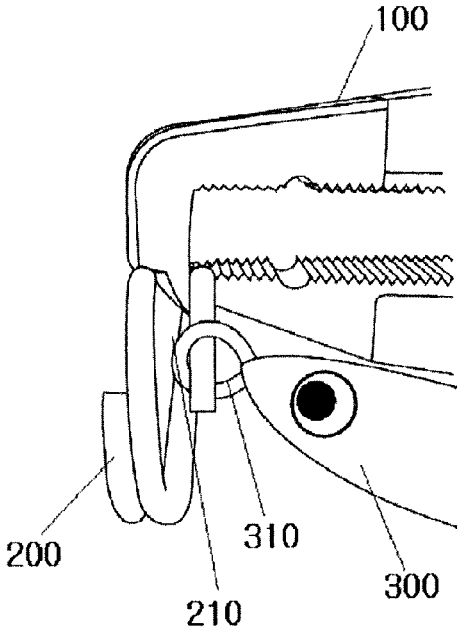

When the pointed tip of the tapered portion 11A is inserted into the gap 210 between the rings of the split ring wound as shown in FIG. 4*a,* and subsequently, a part of the bottom support portion 11B is inserted into the split ring and the gap 210 between the rings of the split ring is widened, a ring 310 connected to an artificial bait 300 is inserted into the gap between the rings as shown in FIG. 4*b.*

Figure 4C:
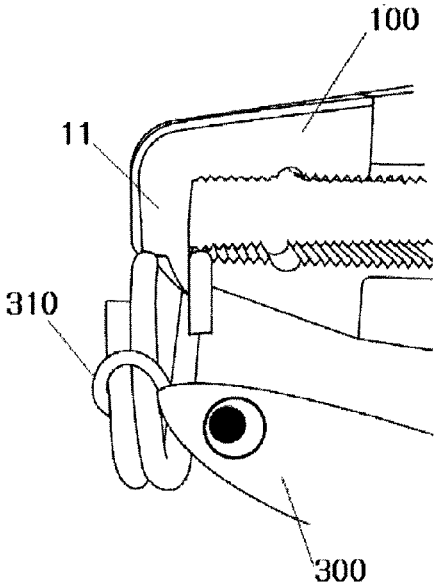

After the ring 310 of the artificial bait 300 is inserted into the gap 210 between the rings of the split ring 200 as shown in FIG. 4*b,* when the ring 310 moves along the gap 210 as shown in FIG. 4*c,* the ring 310 of the artificial bait 300 will be connected to the split ring 200.

As described above, in the present disclosure, the split ring insertion part 11 protrudes in pointed shape in the direction perpendicular to the longitudinal axis direction (L) of the multipurpose pliers, so it can connect the ring 310 of the artificial bait 300 to the split ring 200.

The split ring insertion part 11 of the present disclosure may be preferably used in opening a split ring having an inner diameter of 3 mm-12 mm.

Figure 7A:
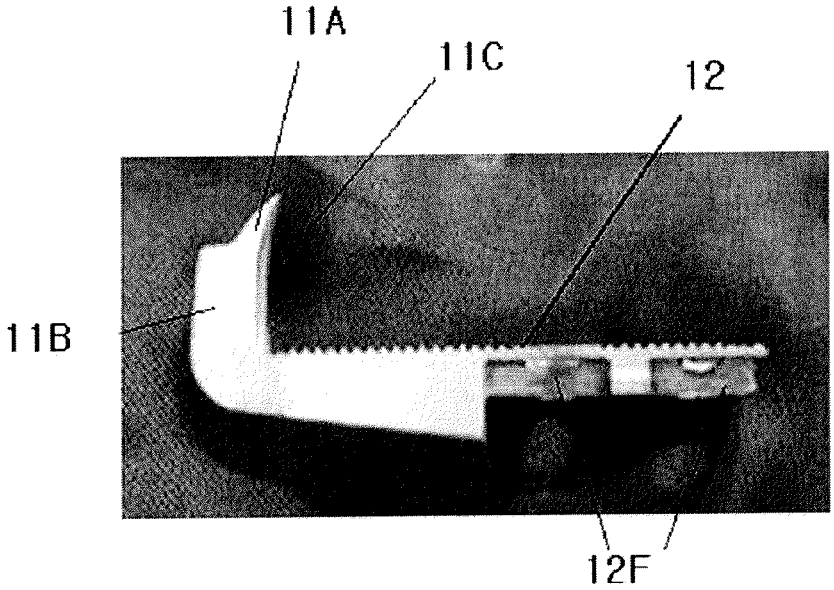
FIG. 7*a* is a diagram showing that a tapered portion 11A, a bottom support portion 11B, and a convex forming portion 11C are formed integrally with a concave-convex part 12 which are then inserted into a lever section.
Figure 7B:
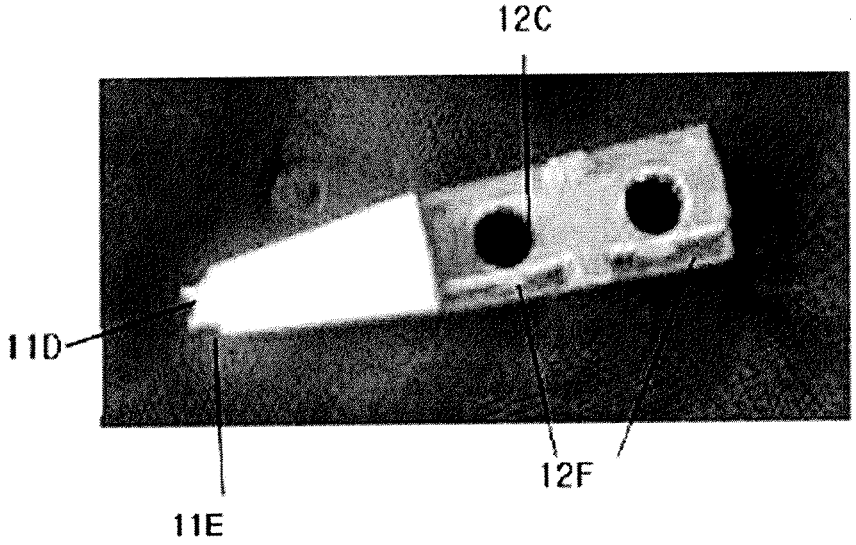
FIG. 7*b* shows that a concave forming portion 11D and a split ring retaining portion 11E are formed integrally with a concave-convex part 12 which are then inserted into a lever section.
Figure 7C:
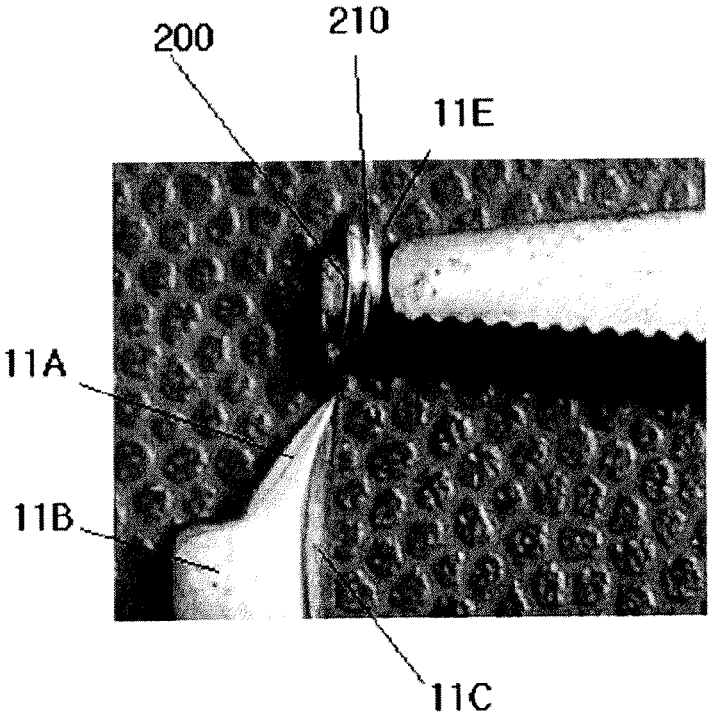
FIG. 7*c* is a diagram of a split ring 200 resting on a split ring retaining portion 11E.

Referring to FIGS. 7*b* and 7*c,* while opening up the rings of the split ring 200 by inserting the tapered portion 11A of the split ring insertion part 11 into the gap 21 between the rings, in order to retain the location of the split ring 200, the split ring retaining portion 11E is formed in the shape of a groove on both side directions from the concave forming portion 11D.

The split ring retaining portion 11E is suitable for small size split rings, for example, having an inner diameter of 3 mm and the split ring retaining portion 11E may be used for larger size split rings. A gap in such split rings may be opened by the tapered portion 11A when the split rings are disposed on the split ring retaining portion 11E as shown FIG. 7*c.*

The tapered portion 11A of the split ring insertion part 11 may include various types, for example, a conical shape, a triangular pyramid shape, and a quadrangular pyramid shape, and likewise, the bottom support portion 11B may include various types, for example, a conical shape, a triangular pyramid shape, and a quadrangular pyramid shape.

Also, the split ring insertion part 11 of the present disclosure may be used to connect artificial baits as well as rings connected to fishing hooks and rings for other purposes. For example, the split ring insertion part 11 of the present disclosure may be used for split rings connected to key rings as well.

Also, the multipurpose pliers 100 of the present disclosure are provided with the concave-convex part 12 adjacent to the split ring insertion part (11) at a direction toward the pivot section, and the concave-convex part 12 has a plurality of concave and convex patterns to grasp hooks, split rings, and the like, without slipping.

Also, the distortion prevention part 13 is provided at a location toward the pivot section from the concave-convex part 12. The distortion prevention part 13 includes a pin 13A protruding in the direction perpendicular to the longitudinal axis (L-axis) formed on one 10A of the pair of lever sections 10, and an accommodating hole formed on the other 10B of the lever sections to accommodate the pin 13A.

When the split ring insertion part 11 is inserted into the gap 210 between the rings of the split ring, a twisting force is applied to the multipurpose pliers, causing distortion to the multipurpose pliers, and the protruding pin 13A of the distortion prevention part 13 offsets the twisting force when inserted into the accommodating hole. The twisting force may occur from the split ring insertion part 11 and may also occur during cutting by the line cutter part 14 and the wire cutter part 15.

Figure 5:
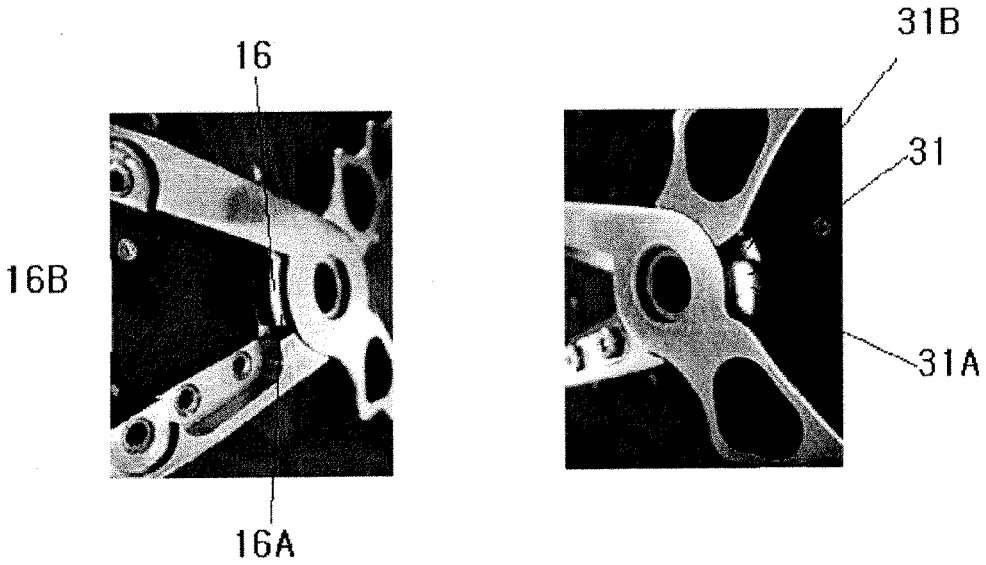
FIG. 5 is an enlarged view of distortion prevention parts 16 and 31 of multipurpose pliers of the present disclosure.

Also, the present disclosure is provided with the distortion prevention parts 16 and 31 adjacent to the pivot section 20 at the side of the lever section 10 and the handle section 30 as shown in FIG. 5.

The distortion prevention parts 16 and 31 are formed such that a pair of circular plates 16A and 16B, and 31A and 31B support each other and exert a force on each other to offset the twisting force applied to the multipurpose pliers.

As described above, the present disclosure improves the life of products by installing the distortion prevention parts 13, 16, and 31 to resist the twisting force applied to the pivot section 20 of traditional multipurpose pliers.

Also, the line cutter part 14 and the wire cutter part 15 are provided adjacent to the distortion prevention part 13 of the lever section 10 in a direction toward the pivot section 20.

The line cutter part 14 has a function of cutting a fishing line, for example, a polyethylene line, a carbon line and a nylon line, and the wire cutter part 15 has a function of cutting a high hardness material such as a wire or a line including a wire.

The wire cutter part 15 has a plurality of grooves to prevent slips that may occur during cutting because of high hardness of a wire or a line including a wire which needs to be cut by the wire cutter part 15, and the wire and the line including the wire is cut when held in the grooves.

Figure 2:
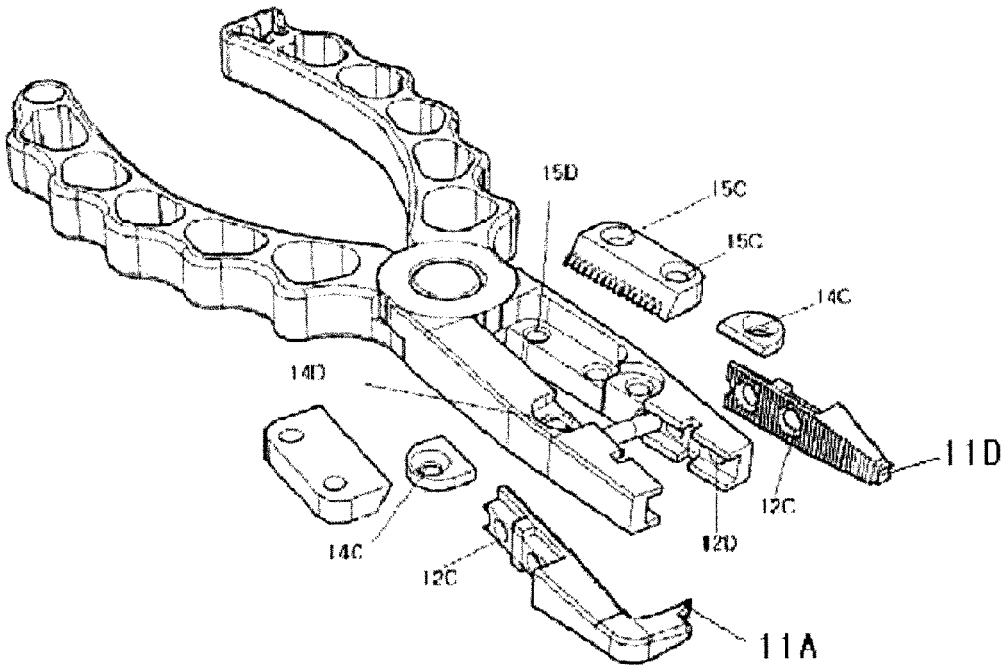
FIG. 2 is an exploded view of multipurpose pliers of the present disclosure.

Also, referring to FIG. 2, the wire cutter part 15, the line cutter part 14, the concave-convex part 12, and the split ring insertion part 11 can be assembled and dissembled via screw coupling accomplished by holes for bolts 15C, 14C and 12C and threaded holes 15D, 14D, and 12D. In the case where the cutter part, the part having the groove, and the tapered portion of the split ring insertion part 11 become blunt while in use, it is possible to replace only the corresponding part with ease.

Figure 6:
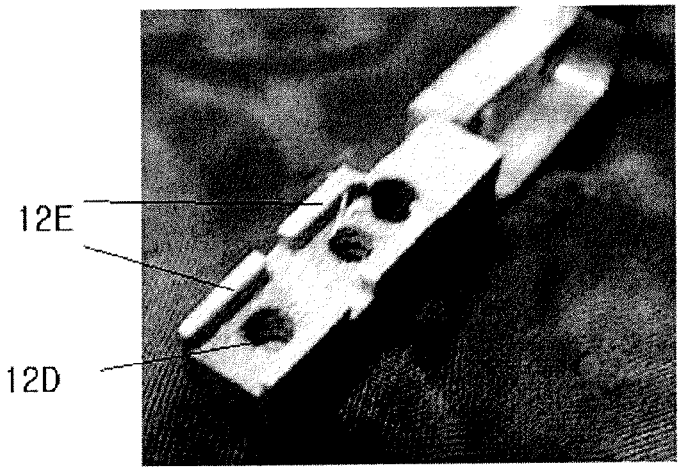
FIG. 6 shows a bottom surface of a lever section into which a split ring insertion part 11 and a concave-convex part 12 of the present disclosure are inserted and assembled.

FIG. 6 shows the bottom surface of the pair of lever sections 10A and 10B into which the split ring insertion part 11 and the concave-convex part 12 integrally formed for each of the pair of lever sections 10A and 10B are inserted and assembled, FIG. 7*a* shows that the tapered portion 11A, the bottom support portion 11B, and the convex forming portion 11C are integrally formed with the concave-convex part 12 which are then assembled into the bottom surface of FIG. 6, and FIG. 7*b* shows that the concave forming portion 11D, and the split ring retaining portion 11E are formed integrally with the concave-convex part 12 which are then assembled into the bottom surface of FIG. 6.

The bolt hole 12C of each arrangement of FIGS. 7*a* and 7*b* and the bolt hole 12D of FIG. 6 are overlapped and bolt-connected to each other, and this is the same case with the bolt holes 12C and 12D of FIG. 2.

Each arrangement of FIGS. 7*a* and 7*b* has four guide holes 12F, and the arrangement of FIG. 6 has guide protrusions 12E which are inserted into the guide grooves 12F, thereby preventing sway during assembly.

Also, the present disclosure has a grease insertion port installed on the side surface of the pivot section 20 to supply greases to the multipurpose pliers of the present disclosure through the grease insertion port.

Also, to reduce the total weight, the present disclosure has a plurality of through-holes 32 in the handle sections, and the handle is in such a shape that they have concave and convex curves to prevent slips while in use.

Figure 8:
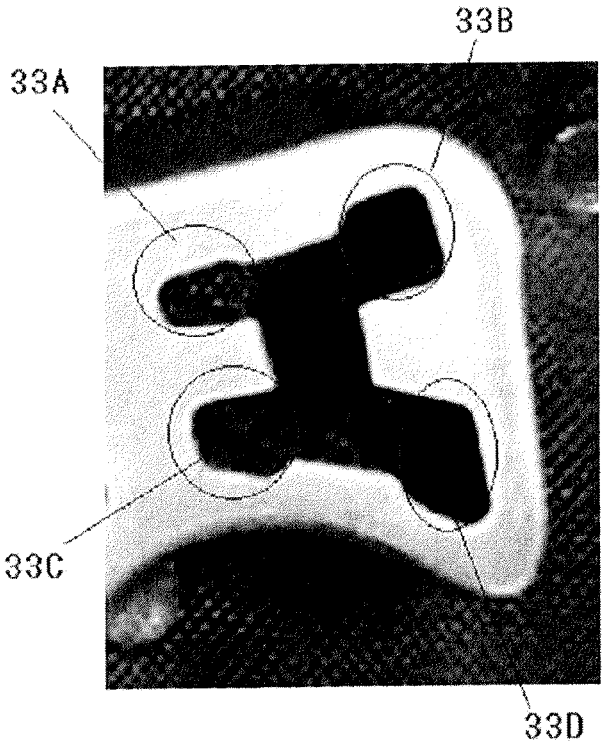
FIG. 8 is a diagram of a fishing hook adjustment part.
Figure 9:
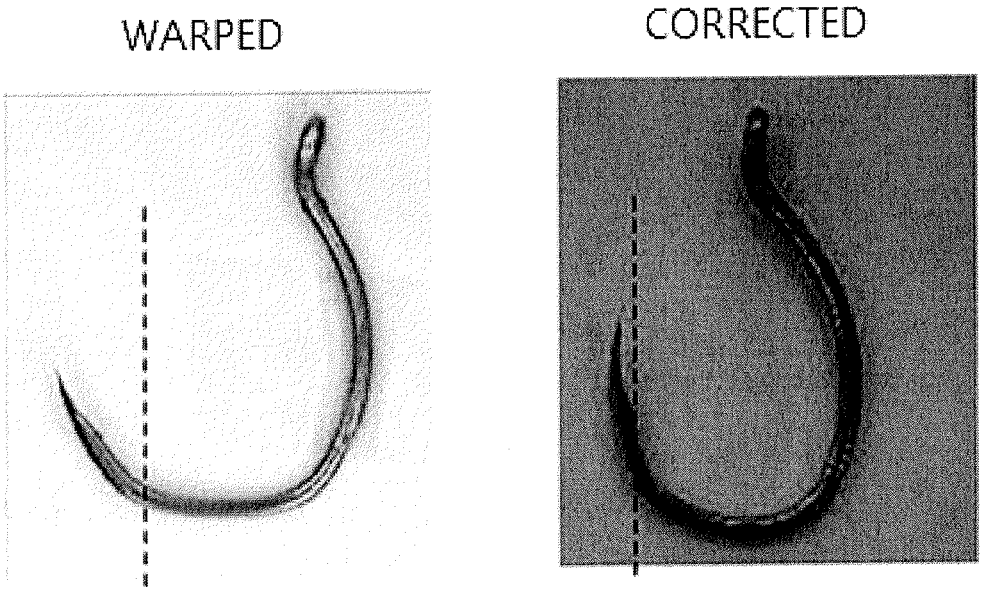
FIG. 9 is a diagram showing adjustment of a fishing hook.

Also, the handle section 30 is further provided with a fishing hook adjustment part 33 to correct an angle of a warped fishing hook. FIG. 8 is an enlarged view of the fishing hook adjustment part 33, and a warped fishing hook is inserted into the adjustment part 33 and is then adjusted as shown in FIG. 9.

In addition, the present disclosure is preferably made of metal and sintered metal, for example, aluminum, tungsten, stainless steel, and titanium.

While the present disclosure has been hereinabove described with respect to particular features such as specific elements and a limited number of embodiments and drawings, this is only provided to help the understanding of the present disclosure more fully, and it should be understood that the present disclosure is not limited to the disclosed embodiments and various modifications and changes may be made by those skilled in the art from the foregoing description. Therefore, the present disclosure shall not be limited to the disclosed embodiments, and the appended claims, along with the full scope of equivalents to which such claims are entitled, will fall within the scope and spirit of the present disclosure.

The invention claimed is:

1. Multipurpose pliers comprising:

a pivot section (20);

a handle section (30) connected to the pivot section (20) on one direction; and a pair of lever sections (10A, 10B) connected to the pivot section (20) on an opposite direction to the one direction, wherein the lever sections (10A, 10B) comprise a split ring insertion part (11), the split ring insertion part (11) comprises a bottom support portion (11B) protruding in a direction perpendicular to a longitudinal axis (L-axis) of the multipurpose pliers at an end of a direction facing away from the pivot section on one (10A) of the pair of lever sections, a tapered portion (11A) extending in the perpendicular direction from top of the bottom support portion (11B) and gradually narrowing to a tip, a convex forming portion (11C) formed on a side surface facing the pivot section of the tapered portion (11A) and the bottom support portion (11B), a concave forming portion (11D) formed at an end of the other (10B) of the pair of lever sections to guide the convex forming portion (11C) on the side surface of the bottom support portion (11B) and the tapered portion (11A), and a split ring retaining portion (11E) formed in a concave shape on both side directions from the concave forming portion (11D), a size of an upper surface of the bottom support portion (11B) is larger than or equal to a size of a bottom surface of the tapered portion (11A), and a gap (210) between rings of a split ring (200) are opened using the tapered portion (11A).

2. The multipurpose pliers according to claim 1, wherein each of the pair of lever sections (10A, 10B) further comprises a concave-convex part (12) adjacent to the split ring insertion part (11) at a direction toward the pivot section, the split ring insertion part (11) and the concave-convex part (12) for each of the pair of lever sections (10A, 10B) are integrally formed, the concave-convex part (12) has guide grooves (12F), bottom surfaces of each of the pair of lever sections (10A, 10B) have guide protrusions (12E), and when the integrally formed split ring insertion part (11) and the concave-convex part (12) of each of the pair of lever sections (10A, 10B) is assembled into the bottom surface of each of the pair of lever sections (10A, 10B), sway is prevented by insertion of the guide protrusions (12E) into the guide grooves (12F).

* * * * *